US009731431B2

(12) United States Patent
Engel

(10) Patent No.: US 9,731,431 B2
(45) Date of Patent: Aug. 15, 2017

(54) MOTOR CHAIN SAW WITH SUPPLY PUMP

(71) Applicant: Andreas Stihl AG & Co. KG, Waiblingen (DE)

(72) Inventor: Bernd Engel, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 799 days.

(21) Appl. No.: 13/899,609

(22) Filed: May 22, 2013

(65) Prior Publication Data

US 2013/0312267 A1 Nov. 28, 2013

(30) Foreign Application Priority Data

May 22, 2012 (DE) ..... 10 2010 009 997

(51) Int. Cl.
*B27B 17/12* (2006.01)
*B27B 17/08* (2006.01)

(52) U.S. Cl.
CPC ..... *B27B 17/12* (2013.01); *B27B 17/08* (2013.01)

(58) Field of Classification Search
CPC ..... B27B 17/12; B27B 17/00; B27B 17/02; B27B 17/08; B27B 17/10; B27B 17/14; Y10T 403/7045; F16D 3/18
See application file for complete search history.

(56) References Cited

U.S. PATENT DOCUMENTS 2,409,775 A 10/1946 Mall
3,099,924 A * 8/1963 Armstrong ..... B27B 17/08 474/152
3,962,929 A * 6/1976 Silvon ..... B27B 17/08 474/152
3,991,864 A 11/1976 Müller
4,140,209 A 2/1979 Müller
4,353,705 A * 10/1982 Scott-Jackson ..... B27B 17/10 29/893.2
4,776,826 A * 10/1988 Scott ..... B23Q 23/00 30/381
4,893,407 A * 1/1990 Lane ..... B27B 17/08 30/123.4

(Continued)

FOREIGN PATENT DOCUMENTS

CN 101745691 6/2010
CN 102166765 8/2011

(Continued)

*Primary Examiner* — Jonathan Riley
(74) *Attorney, Agent, or Firm* — Gudrun E. Huckett

(57) ABSTRACT

A motor chain saw has a first driven sprocket wheel driving a saw chain lubricated via a supply pump driven by first and second drive wheel, wherein the second drive wheel is connected to the first sprocket wheel. A drive element with coupling section is connected to the first sprocket wheel and the second drive wheel is formed on the drive element. A second sprocket wheel can be used in place of the first sprocket wheel. The first and second sprocket wheels have different geometries. The coupling section has first and second followers correlated with follower surfaces of the first and second sprocket wheels. The coupling section contacts with first followers the follower surfaces of the first sprocket wheel or with second followers the follower surfaces of the second sprocket wheel when used in place of the first sprocket wheel.

18 Claims, 6 Drawing Sheets

(56) References Cited

U.S. PATENT DOCUMENTS

| | | | | |
|---|---|---|---|---|
| 5,653,028 | A * | 8/1997 | Hashimoto | B27B 17/12 30/123.4 |
| 6,523,645 | B1 * | 2/2003 | Johansson | B27B 17/12 184/26 |
| 8,607,760 | B2 | 12/2013 | Mornhinweg et al. | |
| 2012/0030954 | A1 | 2/2012 | Heinzelmann | |

FOREIGN PATENT DOCUMENTS

| | | |
|---|---|---|
| CN | 202045687 | 11/2011 |
| SU | 623500 | 9/1978 |
| SU | 2 354 541 | 5/2009 |
| WO | 2006/036875 | 4/2006 |
| WO | 2011/098097 A1 | 8/2011 |

* cited by examiner

MOTOR CHAIN SAW WITH SUPPLY PUMP

BACKGROUND OF THE INVENTION

The invention relates to a motor chain saw comprising a drive motor driving by means of a sprocket wheel a saw chain, wherein teeth of the sprocket wheel engage the saw chain and the saw chain is supplied with chain oil for lubrication by means of a supply pump. The supply pump is driven by a pump drive that is comprised of a first drive wheel connected with the supply pump and a second drive wheel that is connected with the sprocket wheel, wherein the drive wheels are drivingly connected to each other. The second drive wheel is formed on a drive element provided with a coupling section that produces a positive fit drive connection between the drive element and the sprocket wheel, for which purpose the coupling section has followers having correlated therewith follower surfaces formed on the sprocket wheel, wherein in circumferential direction of the sprocket wheel several follower surfaces of the sprocket wheel are contacting several followers of the coupling section.

U.S. Pat. No. 6,523,645 B1 discloses a supply pump of a motor chain saw by means of which chain oil is supplied to a saw chain that is driven by means of a sprocket wheel. The pump drive of the supply pump is comprised of a first drive wheel that is connected to the supply pump and a second drive wheel that is connected to the sprocket wheel; the drive wheels are in driving connection with each other. The second drive wheel is embodied as a worm gear on a drive element that engages with a coupling section the sprocket wheel such that it is in positive fit drive connection with the sprocket wheel. The coupling section has for this purpose several followers distributed about the circumference and the followers have correlated therewith follower surfaces that are formed on the sprocket wheel. In this context, the followers each engage between two teeth of the driving sprocket wheel and are in drive connection with the sprocket wheel.

When a motor chain saw is to be furnished with a different saw chain, for example, provided with a different pitch, the sprocket wheel must be exchanged in accordance with the type of the employed saw chain in order to ensure a drive connection with the sprocket wheel that matches shape and pitch of the saw chain. When the geometry of the sprocket wheel is changed, the drive element for the supply pump must be changed also because the coupling section is configured in accordance with the geometry of the employed sprocket wheel.

Upon exchange of a saw chain kit, not only the sprocket wheel but also the drive element for the supply pump must therefore be exchanged; this is a complex process and cumbersome.

SUMMARY OF THE INVENTION

It is an object of the present invention to simplify the configuration of the drive connection between a sprocket wheel and a drive element for driving a supply pump.

In accordance with the present invention, this is achieved in that the motor chain saw has a first sprocket wheel of a first geometry and a second sprocket of a second geometry and the first and second sprocket wheels are exchangeable. The coupling section of the drive element has several first followers formed thereon that are correlated with the first sprocket wheel and the same coupling section of the same drive element has several second followers formed thereon that are correlated with the second sprocket wheel. The coupling section is contacting with the first followers or with the second followers the correlated follower surfaces of the first sprocket wheel or of the second sprocket wheel used for driving, respectively.

On the coupling section of the drive element according to the invention, several first followers are formed that are correlated with a first sprocket wheel of a first geometry. On the same coupling section of the same drive element, several second followers are formed that are correlated with a second sprocket wheel of a second geometry. In this context, the first geometry is different from the second geometry. The first geometry differs from the second geometry, for example, with respect to pitch and/or the number of teeth and/or diameter. In this connection, the followers are arranged such that the coupling section is contacting with the first or second followers the respective correlated follower surfaces of the first sprocket wheel or second sprocket wheel that is being used for driving.

By providing several followers on the coupling section that are correlated with different sprocket wheels, the same drive element is useable for several sprocket wheels of different geometry so that upon exchange of the saw chain kit the drive element must not be exchanged generally. This simplifies the exchange of a saw chain kit on a motor chain saw.

The follower surface is preferably formed on a tooth of the sprocket wheel so that no special engagement means are required on the sprocket wheel itself. In this context, the follower engages the tooth axially across a partial width wherein the partial width is smaller than 30% of the total axial width of the tooth. This partial width of the follower surface is sufficient for a pump driving action.

In the circumferential direction of the drive element, two first followers form a follower pair and two second followers form a follower pair, respectively, wherein each follower pair in the circumferential direction, i.e. In both rotational directions of the sprocket wheel, delimits a receptacle for a correlated tooth of the first or the second sprocket wheel, respectively. In this context, the configuration is advantageously such that in the circumferential direction of the drive element alternatingly a first follower pair (follower pair of first followers) and a second follower pair (follower pair of second followers) follow each other.

In order to further adjust the drive element for use with several sprocket wheels, it is provided that the first receptacles, relative to the axis of rotation of the drive element, are provided on the coupling section diametrically opposite each other and the second receptacles, relative to the axis of rotation of the drive element, are positioned diametrically opposite each other. In this way, an arrangement of the followers relative to an axial plane of the drive element can be realized such that the followers are positioned symmetrical to this axial plane.

A first receptacle that is formed by the first followers is provided in the circumferential direction of the drive element with a smaller extension than the extension of a second receptacle formed by the second followers. Accordingly, the first receptacle has a smaller extension (length) in the circumferential direction than the second receptacle.

In order to take into consideration a different number of teeth and a different pitch of the sprocket wheel by simple means, it is proposed to arrange a large idle distance section between the first and the second follower pairs in the circumferential direction of the drive element. This idle distance section is located between the follower pair of the first followers and the follower pair of the second followers and has an extension or length that is greater than the extension or length of the receptacles, the length being measured between the facing sides of the first followers or between the facing sides of the second followers of a follower pair, respectively.

Advantageously, the idle distance section between the follower pairs in the circumferential direction of the drive element is at least twice as large as the maximum extension of a receptacle in the circumferential direction.

A tooth of a driving sprocket wheel is secured in circumferential direction of the drive element in the correlated receptacle of a follower pair with tolerance in such a way that an easy manufacture and assembly of the drive element on the sprocket wheel is ensured. It can be expedient to secure the driving sprocket wheel in the receptacle substantially without play (clearance). In this connection, it is advantageous when, in the rotational direction of the sprocket wheel, driving teeth that are neighboring each other about the circumference of the coupling section are contacting first and second followers wherein one of the driving teeth is secured in the corresponding receptacle of a follower pair.

The configuration according to the invention of the positive fit drive connection of the drive element that is comprised of plastic and that is pushed onto the sprocket wheel comprised of metal is thus embodied such that, independent of the geometric configuration of the sprocket wheel participating in the drive connection, only a subset of the teeth of the driving sprocket wheel are in driving connection with the followers. In this connection, it is advantageous that the followers are positioned with radial play relative to the base between two teeth. As a result of the different geometry of the employed sprocket wheels, the connecting contour of the sprocket wheel facing the drive element is different in regard to design, shape and/or geometry. According to the invention, the same drive element can be used for driving the supply pump despite the different connecting patterns of the connecting contour of the sprocket wheels.

DESCRIPTION OF THE PREFERRED EMBODIMENTS

Figure 1:
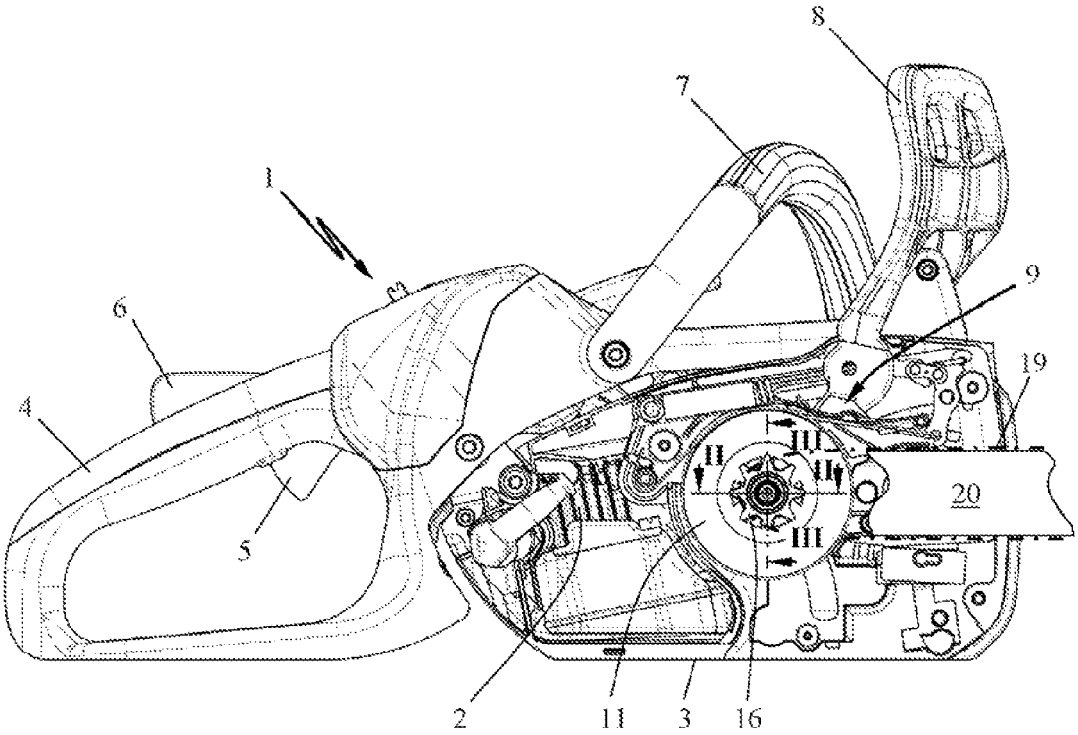
FIG. 1 is a view, partially in section along the section line I-I in FIG. 3, of a power tool embodied in an exemplary fashion as a motor chain saw.

In the illustrated embodiment a portable hand-guided power tool is illustrated in an exemplary fashion as a motor chain saw 1. The motor chain saw 1 is comprised substantially of a drive motor 2 that, in the illustrated embodiment, is an internal combustion engine, in particular a two-stroke internal combustion engine. Electric motors can be used also as a drive motor.

The drive motor 2 is mounted in a housing 3 which has a rear handle 4 extending in the longitudinal direction 23 (FIG. 2) of the housing 3 and provided with operating elements 5, 6 for the drive motor. A front handle 7 extends transversely to the longitudinal direction 23 of the motor chain saw 1 across the housing 3. In front of this front handle 7 that is disposed on the topside of the housing 3 there is a pivotable hand guard 8 which serves for triggering a safety brake device 9.

Figure 2:
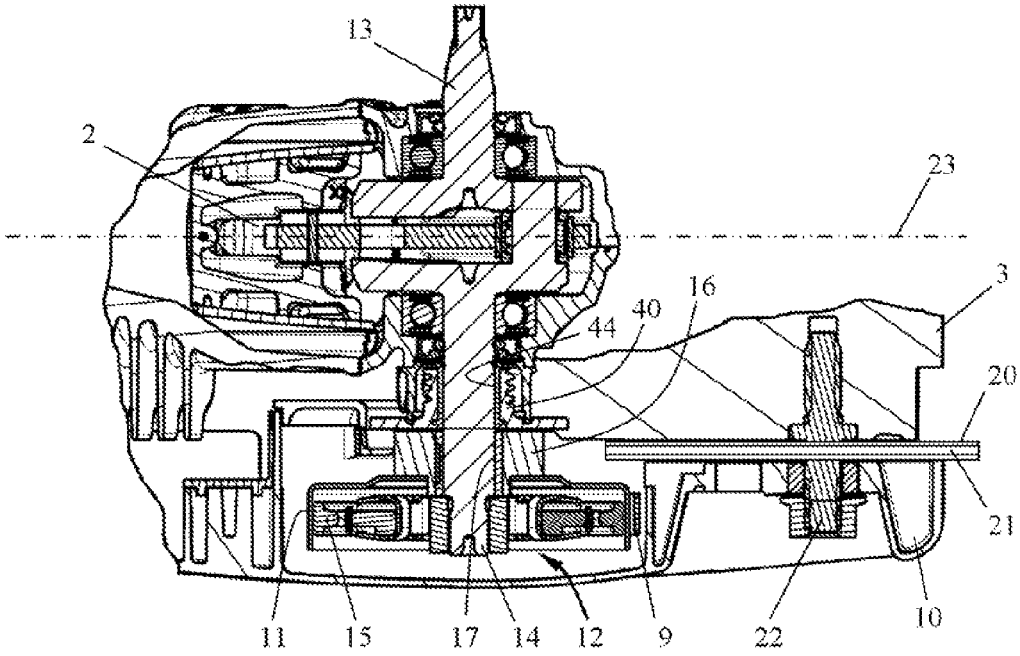
FIG. 2 is a partial section view of the power tool according to FIG. 1 along the section line II-II.
Figure 3:
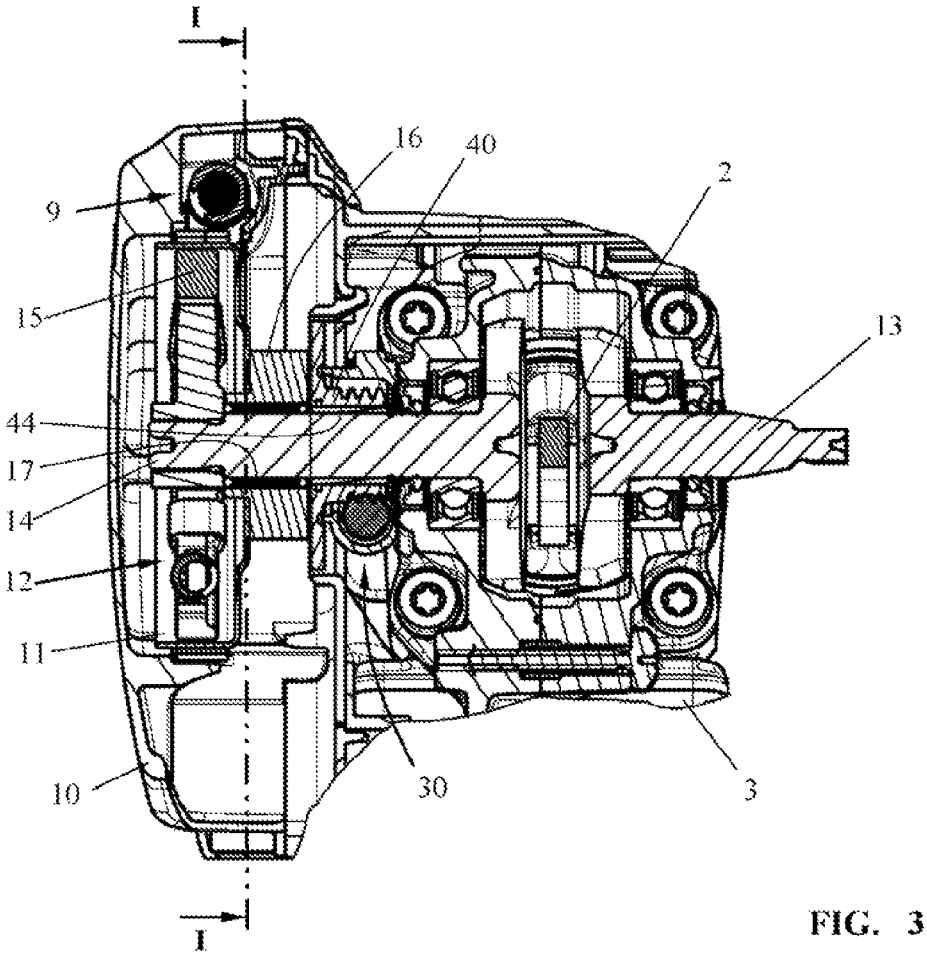
FIG. 3 is a partial section view of the power tool according to FIG. 1 along the section line III-III.

As shown in FIGS. 2 and 3, the safety brake device 9 is received in a removable sprocket wheel cover 10 into which a coupling drum 11 of a centrifugal clutch 12 is projecting. The drive shaft 13 that is driven by the drive motor 2 is embodied in the illustrated embodiment as a crankshaft of the internal combustion engine and drives with end 14 the centrifugal clutch 12. Once a certain rotary speed is reached, the coupling elements 15 contact the coupling drum 11 so as to transmit torque and entrain the coupling drum 11 in the rotational direction of the drive shaft 13.

Figure 9:
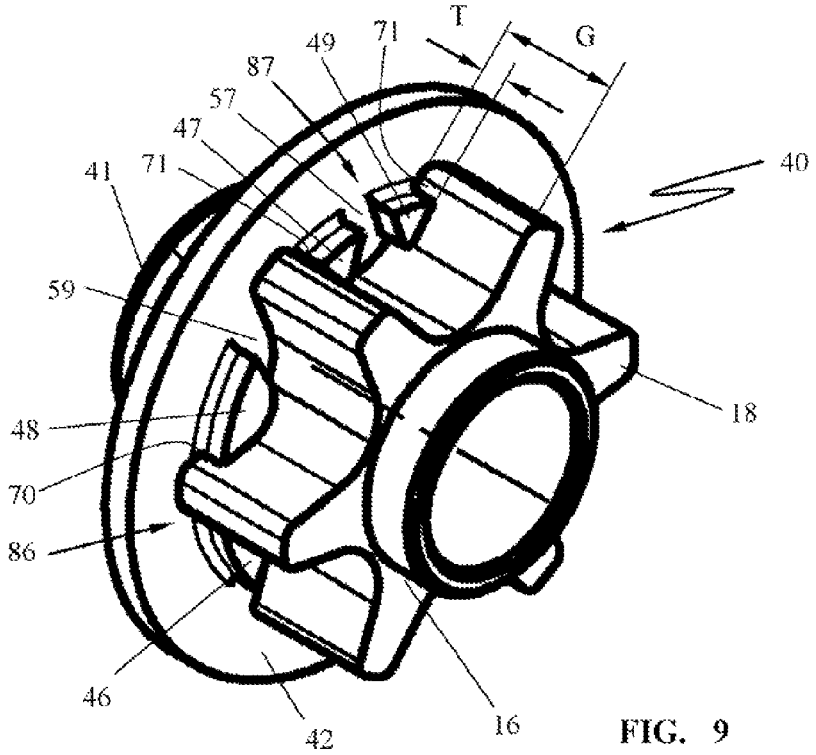
FIG. 9 is a perspective illustration of the first drive connection according to FIG. 8.

A sprocket wheel 16 is fixedly connected to the coupling drum 11 and is illustrated perspectively, for example, in FIG. 9. The sprocket wheel 16, together with the coupling drum 11, is rotatably supported with a bearing 17 on the drive shaft 13. The end 14 of drive shaft 13 penetrates the bearing 17 and supports on the projecting end 14 the carrier of the coupling elements 15.

On its circumference, the sprocket wheel 16 has sequentially arranged teeth generally identified by 18 that engage drivingly a saw chain 19 and drive the saw chain 19 in circulation about a guidebar 20. For guiding the saw chain 19, the peripheral rim of the guidebar 20 is provided with a peripheral groove 21 (FIG. 2). The guidebar 20 is clamped between housing 3 and sprocket wheel cover 10 by means of clamping bolts 22. The guidebar 20 extends in longitudinal direction 23 of the power tool.

For lubricating the saw chain 19 that is circulating on the guidebar 20, the peripheral groove 21 is supplied with chain oil by means of a supply pump 30, illustrated in FIG. 3 in partial section. The supply pump 30 is driven by a pump drive 25 which is in drive connection with the sprocket wheel 16.

Figure 4:
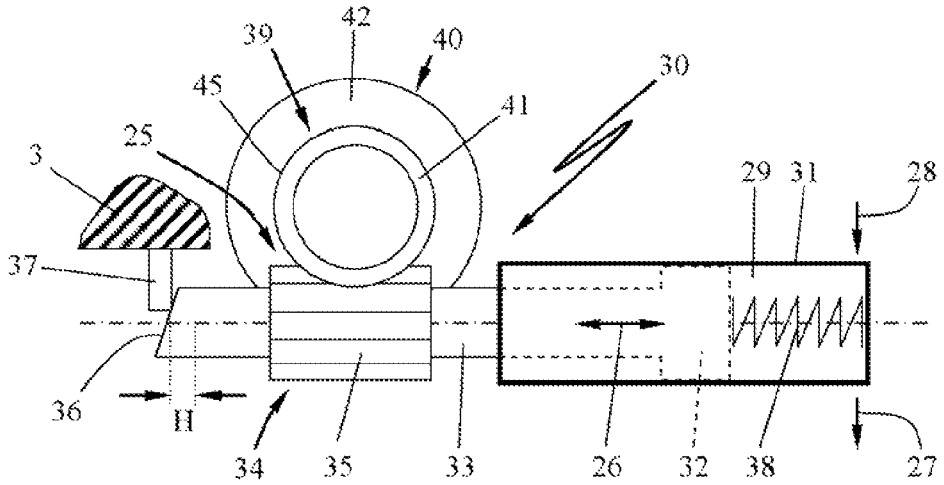
FIG. 4 is a schematic illustration of a supply pump integrated into the power tool.

As shown in the schematic illustration of FIG. 4, the supply pump 30 is comprised of a conveying cylinder 31 in which a conveying piston 32 is inserted. The conveying piston 32 is rotatingly driven in that a first drive wheel 34 is provided on the piston rod 33 and is embodied as a pinion 35. The free end 36 of the piston rod 33 is supported on a lifting pin 37 that is fast with the housing and interacts with a cam on the end of the piston rod 33. By means of a schematically indicated spring 38 the cam on the end 36 is held in contact with lifting pin 37.

Upon rotating drive action acting on of the piston rod 33, the piston rod 33 is moved in accordance with the height H of the cam at the end 36 so that a reciprocating movement in accordance with double arrow 26 results. Accordingly, an operating medium, for example, chain oil, flows in direction of arrow 28 into the pump chamber 29 and is then transported in the direction of arrow 27 to the consumer, in the illustrated embodiment into a peripheral groove 21 of the guidebar 20.

Figure 5:
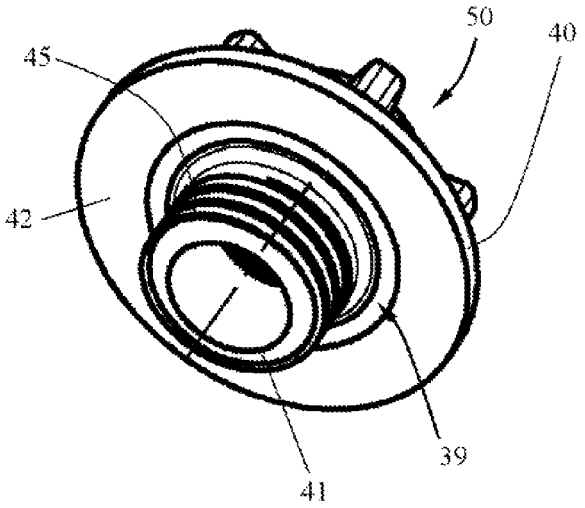
FIG. 5 is a perspective illustration of a drive element of the supply pump according to FIG. 4.
Figure 6:
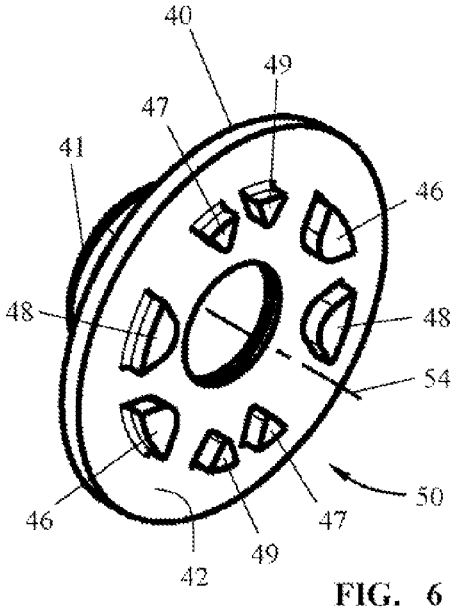
FIG. 6 is a perspective view of the coupling section of the drive element according to FIG. 5.
Figure 7:
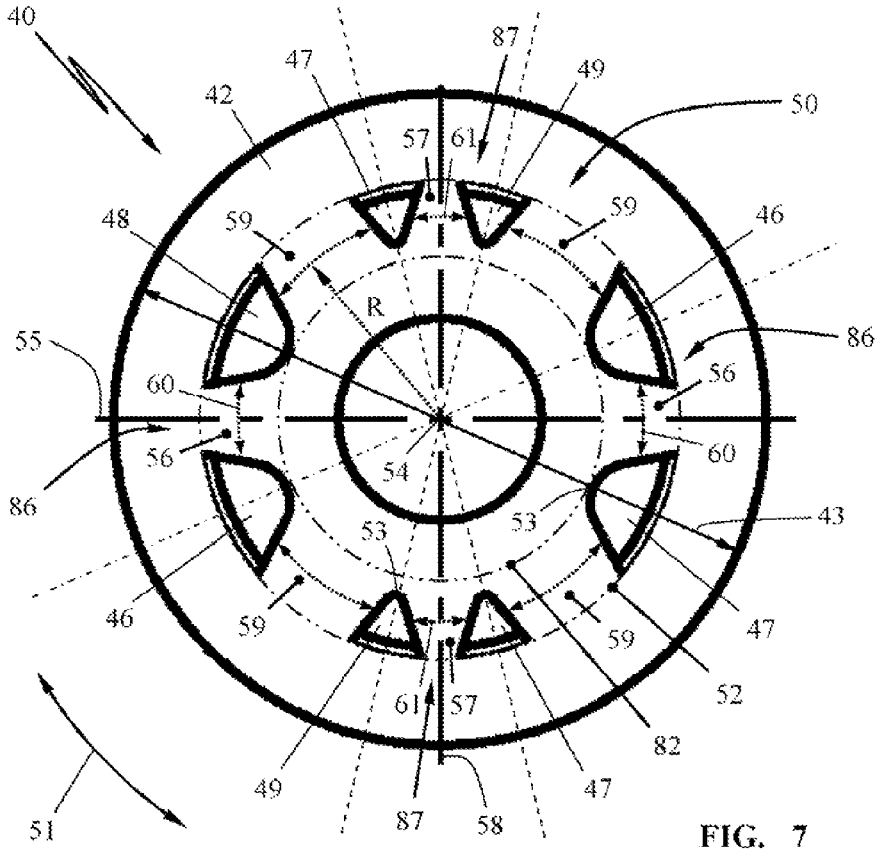
FIG. 7 is a plan view of the coupling section according to FIG. 6.
Figure 8:
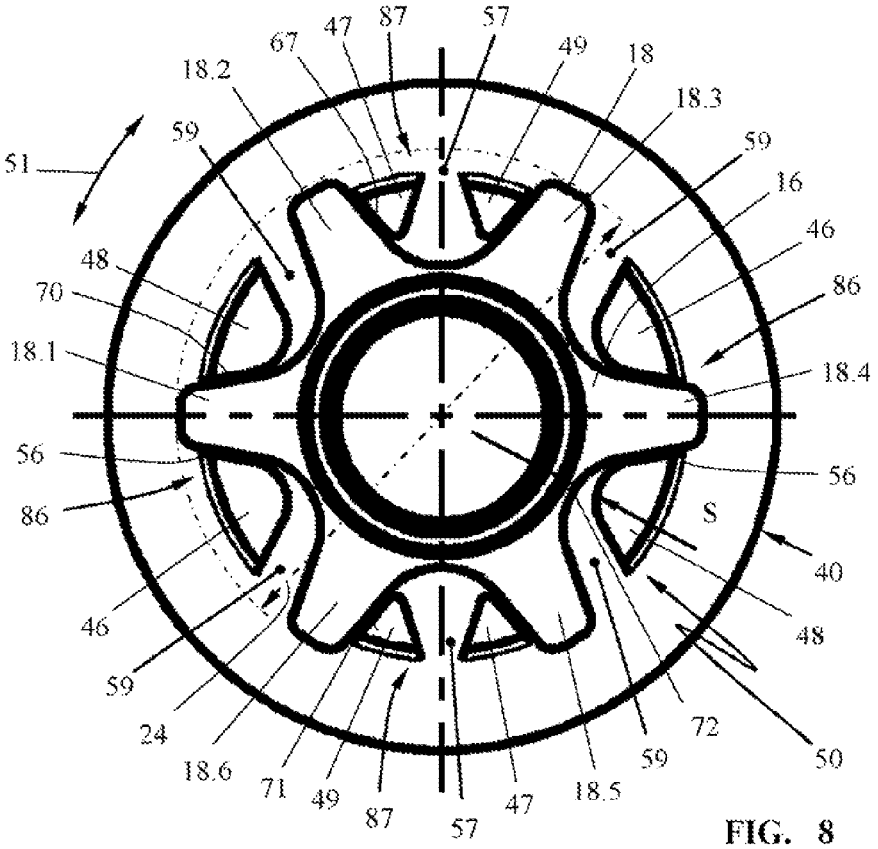
FIG. 8 is a schematic illustration of a first drive connection of the drive element with a first sprocket wheel comprising six teeth.

When the centrifugal clutch 12 is not engaged, the saw chain 19 is not circulating; the saw chain is standing still. When the saw chain 19 is standing still, conveyance of chain oil into the peripheral groove 21 is undesirable. Therefore, the supply pump 30 is driven by the output side of the centrifugal clutch 12 for which purpose in the illustrated embodiment a drive element 40 is provided that is illustrated in FIGS. 5 to 7. The drive element 40 is an essentially cylindrical bushing with an annular collar 42 formed at one end. The outer diameter 43 of the collar 42 is greater than the outer diameter 24 of the sprocket wheel 16 (FIG. 8).

As can be seen in FIG. 3, the supply pump 30 is arranged below the drive shaft 13 and the drive shaft 13 penetrates through the drive element 40. The drive element 40 is rotatably supported by means of a bearing 44, preferably a slide bearing, on the drive shaft 13. The cylindrical bushing 41 is formed on its outer circumference as a second drive wheel 39, i.e., as a worm gear 45 which (compare FIG. 4) meshes with the pinion 35 of the supply pump 30.

The collar 42 provided at one end of the bushing 41 is positioned with its end face so as to face the sprocket wheel 16. The end face of the collar 42 that is facing the sprocket wheel 16 is provided with a coupling section 50. The coupling section 50 comprises axially projecting followers 46, 47, 48, 49 on the end face of the collar 42. In the illustrated embodiment, in the circumferential direction 51 of the drive element 40 at least two first followers 46, 48 and two second followers 47, 49 are provided on the end face. In an axial end view, the followers have a U-shaped or V-shaped basic form and are arranged on a common circumferential circle 52. From the circumferential circle 52, the followers project with their tips 53 radially in inward direction toward the axis of rotation 54. Two pairs of first followers 46, 48 are positioned diametrically opposite each other relative to the axis of rotation 54; two pairs of second followers 47, 49 are positioned diametrically opposite each other relative to the axis of rotation 54.

In the circumferential direction 51, a first receptacle 56 is formed between two first followers 46 and 48 and a second receptacle 57 is formed between two second followers 47 and 49. The receptacles 56 are designed for receiving a tooth 18 of the sprocket wheel 16 that is arranged on the coupling drum 11.

In the illustrated embodiment, in the circumferential direction 51 of the drive element 40 a first follower pair 86 and a second follower pair 87 are provided that alternatingly follow each other. Relative to the axis of rotation 54 of the drive element 40, the coupling section 50 has two first receptacles 56, positioned relative to the axis of rotation 54 diametrically opposite each other, and two second receptacles 57, positioned likewise relative to the axis of rotation 54 diametrically opposite each other. The arrangement is such that the followers 46, 48 and 47, 49 or the follower pairs 86, 87 are symmetrical to an axial plane 55, 58. In this context, the axial plane 55 is positioned perpendicularly to the axial plane 58.

The configuration of the drive element 40 or its coupling section 50 is designed such that the receptacle 56 formed by the first followers 46, 48 in circumferential direction 51 has a greater extension (length) 60 than the extension (length) 61 that results on the same radius R in the second receptacle 57 between the two second followers 47, 49.

The idle distance section 59 measured in the circumferential direction 51 of the drive element 40 between a first follower pair 86 of the first followers 46, 48 and a second follower pair 87 of the second followers 47, 49 has a length that is greater than the length 60, 61 of the receptacles 56, 57 measured between the faces of the followers 46, 48; 47, 49. In the illustrated embodiment, the length of the idle distance section 59 is at least twice as large as the maximum extension (length) 61 of a receptacle 56.

The design of the drive element 40 according to the invention with the coupling section 50 that is designed in a special way enables a drive connection of geometrically differently designed sprocket wheels with the drive element 40 of the supply pump 30. The coupling section 50 embodied according to the invention enables for geometrically differently designed sprocket wheels (different number of teeth, different pitch of the teeth) a positive fit drive action of a sprocket wheel on the drive element 40 and thus on the supply pump 30.

In FIGS. 8 and 9, a first sprocket wheel 16 is illustrated which has six teeth 18 (individual teeth are identified by 18.1 . . . 18.6) distributed uniformly about the circumference. In the circumferential direction 51, the drive connection between the sprocket wheel 16 and the coupling section 50 of the drive element 40 is achieved in that two teeth 18.1 and 18.4 are received in the first receptacles 56 that are delimited by the first followers 46 and 48. The first sprocket wheel 16 is secured with its teeth 18.1 and 18.4 substantially without play (clearance) in the correlated receptacle 56 of the first follower pair 86, respectively. As a result of the arrangement of the followers 46, 47, 48 and 49 according to the present invention as illustrated in FIG. 7 and the spacings of the followers 46, 47, 48, 49 relative to each other in the circumferential direction, it is further apparent that the first sprocket wheel 16 is not only fixed in the first receptacles 56 but is also contacting the second followers 47 and 49 that are following the first receptacle 56 in the circumferential direction 51. The tooth 18.2 or the tooth 18.6, positioned in the idle distance section 59 adjacent to the first receptacle 56, is thus contacting outside of the second receptacle 57 the contact surfaces 67 of the second followers 47 and 49. In the circumferential direction 51, and thus in both rotational directions of the sprocket wheel 16, there are adjacently positioned teeth 18.1, 18.2, and 18.6 that are contacting the first followers 46 and 48 and the second followers 47 and 49, wherein the intermediately positioned tooth 18.1 is secured in the correlated first receptacle 56.

For producing the positive fit drive connection between the drive element 40 and the first sprocket wheel 16, the followers 46, 47, 48, 49 engage the teeth 18 axially such that follower surfaces 70 and 71 that are formed on the teeth 18 are contacting the correlated first and second followers 46, 48 and 47, 49, respectively. As shown in FIG. 9, a follower 46, 47, 48 and 49 engages across a partial width T axially the tooth 18 wherein the partial width T is preferably less than 30% of the total axial width G of the tooth 18.

In the embodiment according to FIGS. 10 to 13, a sprocket wheel 116 or 216 is shown on which eight teeth 118 or 218 are provided. The second sprocket wheel 116 is thus different from the first sprocket wheel 16 in that it has a different number of teeth. The first sprocket wheel has teeth 18.1 to 18.6 while the second sprocket wheel has teeth 118, individually identified by 118.1 to 118.8. Despite the different geometric configuration of the second sprocket wheel 116, the sprocket wheel 116 is coupled with the same drive element 40 in the same way in the circumferential direction 51, as can be seen in the perspective illustration of FIG. 11.

Figure 10:
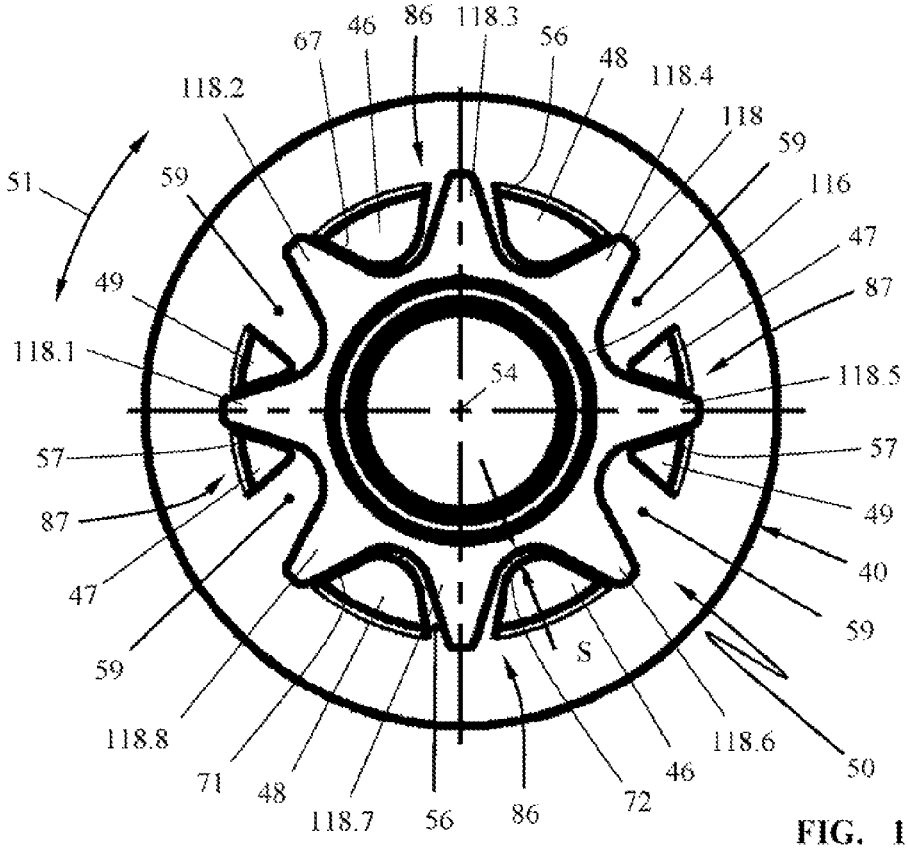
FIG. 10 is a schematic illustration of a second drive connection of the drive element with a second sprocket wheel with eight teeth.

While in case of the first sprocket wheel 16 according to FIG. 8 a tooth 18.1 or 18.4 is substantially received without clearance in the first receptacle 56, in case of the second sprocket wheel 116 according to FIG. 10 a tooth 118.1 as well as a diametrically opposed tooth 118.5 are received substantially without clearance in the second receptacle 57 between the followers 47 and 49. It this way, a positive fit coupling without clearance of the coupling section 50 of the same drive element 40 with a second sprocket wheel 116 of a different geometric shape is achieved.

In the second sprocket wheel, the follower surfaces 70 and 71 of the teeth 118.1 to 118.8 are also contacting the correlated followers. Follower surfaces 70 of a tooth 118.1, 118.5 are contacting the followers 47 and 49 within the second receptacle 57. The follower surfaces 71 of the teeth 118.8 and 118.2 that are neighboring tooth 118.1 received in the receptacle 57 are contacting the first followers 46 and 48. Accordingly, teeth 118.1 and 118.5 of the driving second sprocket wheel 116 are secured in circumferential direction 51 of the drive element 40 in the correlated second receptacle 57 of a follower pair 87 substantially without clearance. In the circumferential direction 51, i.e., in both rotational directions of the sprocket wheel 116, driving teeth 118.2 and 118.8 that are neighboring the tooth 118.1 about the circumference of the coupling section 50 are contacting the first followers 46, 48.

In the first receptacle 56 between the followers 46 and 48 a tooth 118.3 that follows in the circumferential direction 51 is provided that has clearance in the rotational direction 51.

Figure 11:
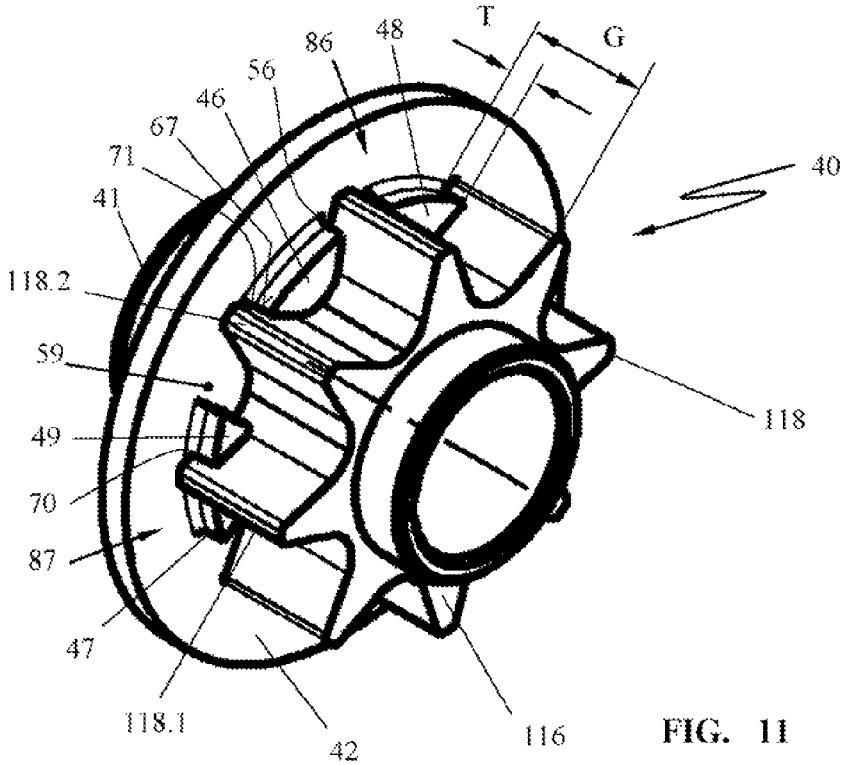
FIG. 11 is a perspective illustration of the second drive connection according to FIG. 10.
Figure 12:
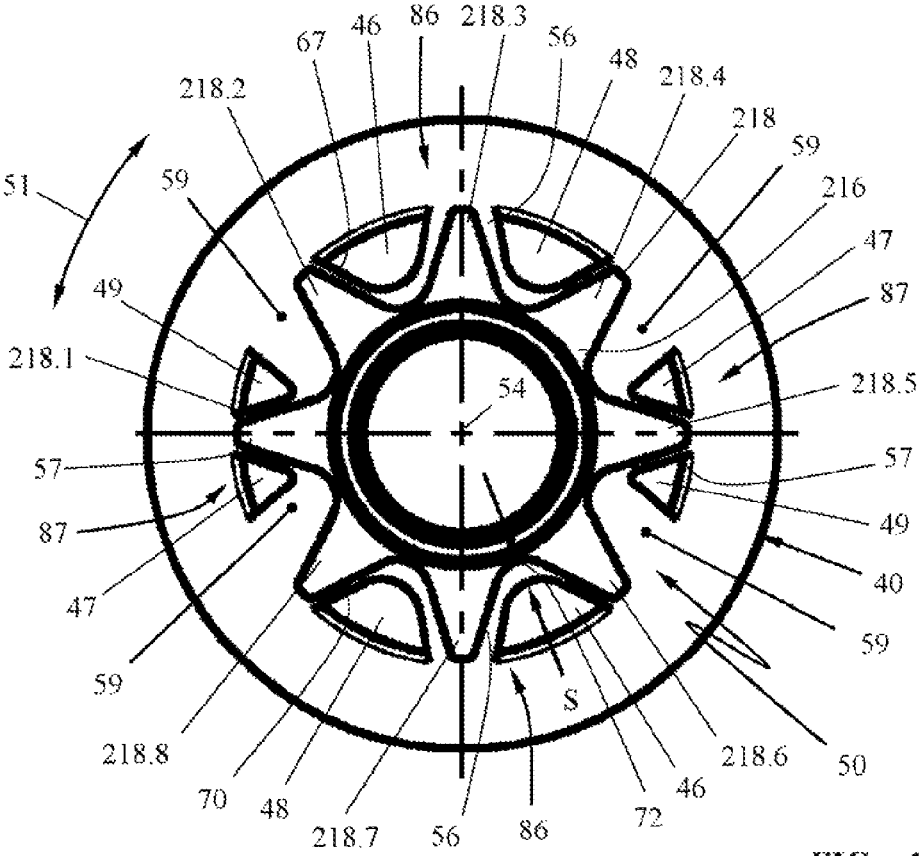
FIG. 12 is a schematic illustration of a third drive connection of the drive element with a third sprocket wheel with eight teeth and changed pitch.
Figure 13:
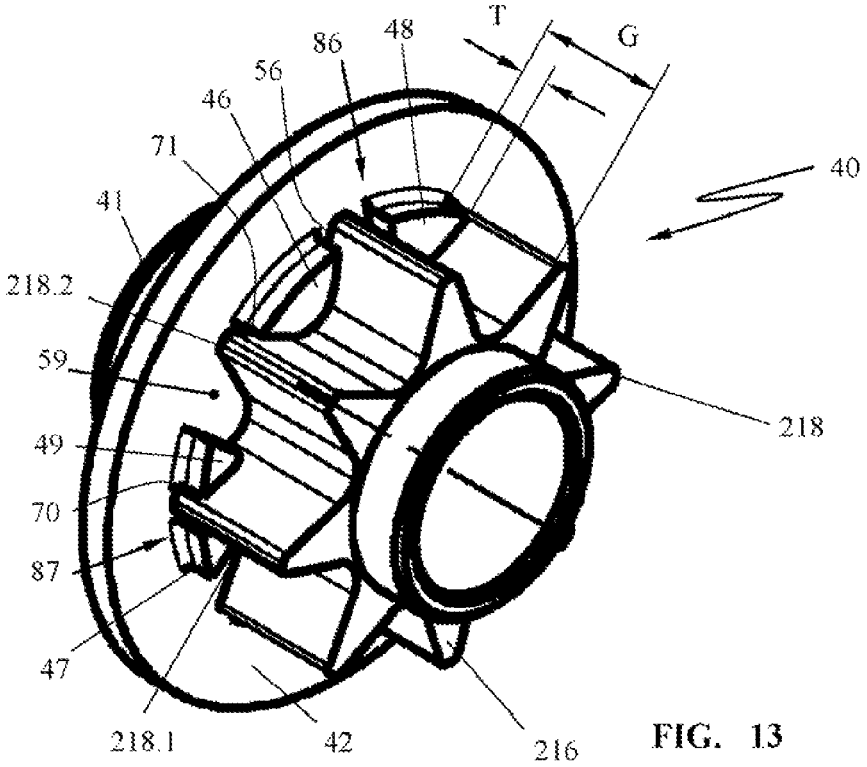
FIG. 13 is a perspective view of the third drive connection according to FIG. 12.

The sprocket wheel 216 of FIGS. 12 and 13 differs from the sprocket wheel 116 according to FIGS. 10 and 11 by a different pitch for the same number of teeth 218, individually identified by 218.1 to 218.8. This third sprocket wheel 216 is secured by the coupling section 50 of the same drive element 40 with positive fit in the circumferential direction 51, i.e., in both rotational directions, wherein the same position of the teeth 218.1 and 218.5 in the second receptacles 57 is provided as in FIG. 10. Accordingly, the arrangement is substantially the same. As a result of the different pitch, the followers 46 to 49 with their tips 53 are positioned with greater radial clearance S relative to the base 72 between two of the teeth 218, respectively.

For the second sprocket wheel 116, the radial clearance S to the base 72 is less in the embodiment according to FIG. 10. In the first sprocket wheel 16 the clearance S to the base is greater. Important is that the first, second and third sprocket wheels 16, 116, 216 each have a minimal clearance S between base 72 and the tips 53 when positioned on the coupling section 50.

All embodiments, especially FIGS. 10 to 13, have in common that for a positive fit drive connection of the drive element 40 pushed onto the sprocket wheel 16, 116, 216 only a subset of the teeth 18, 118, 218 of the driving sprocket wheel 16, 116, 216 are in drive connection with the followers 46, 47, 48, 49.

In the drive connection between the drive element 40 and one of the sprocket wheels 16, 116, 216, a coupling between the drive element 40 made of plastic material and the sprocket wheel 16, 116, 216 made of metal is provided. The drive element 40 engages the sprocket wheel 16, 116, 216 axially. In the circumferential direction 51 of the drive element 40, the followers 46, 47, 48, 49 are positioned between the teeth 18, 118, 218 of a sprocket wheel 16, 116, 216 so that in the rotation direction 51 a positive fit drive action is provided.

The specification incorporates by reference the entire disclosure of German priority document 10 2012 009 997.5 having a filing date of May 22, 2012.

While specific embodiments of the invention have been shown and described in detail to illustrate the inventive principles, it will be understood that the invention may be embodied otherwise without departing from such principles.

What is claimed is:

1. A drive system for a supply pump of a motor chain saw, wherein the motor chain saw comprises a drive motor;

a saw chain;

a first sprocket wheel operatively connected to the drive motor;

the first sprocket wheel comprising first teeth engaging the saw chain for driving the saw chain;

wherein the supply pump supplies the saw chain with chain oil for lubricating the saw chain;

a pump drive operatively connected to the supply pump and comprising a first drive wheel and a second drive wheel, wherein the first drive wheel is connected to the supply pump and the second drive wheel is connected to the first sprocket wheel, and wherein the first and second drive wheels are drivingly connected with each other;

a rotatingly driven drive element comprising a coupling section, wherein the coupling section in at least one rotary direction of the drive element is drivingly connected with form fit to the first teeth of the first sprocket wheel;

the second drive wheel formed on the drive element;

the coupling section comprising first followers and the first teeth of the first sprocket wheel project in a radial direction between the first followers;

the first sprocket wheel comprising first follower surfaces correlated with the first followers of the coupling section, respectively, wherein in a circumferential direction of the first sprocket wheel in the at least one rotary direction of the drive element a subset of the first follower surfaces of the first sprocket wheel are contacting a subset of the first followers of the coupling section;

a second sprocket wheel exchangeable for the first sprocket wheel and having second teeth engaging the saw chain for driving the saw chain, wherein the first sprocket wheel with the first teeth has a first geometry and the second sprocket wheel with the second teeth has a second geometry different from the first geometry;

the coupling section comprising second followers and, when the second sprocket wheel is used in place of the first sprocket wheel, the coupling section in the at least one rotary direction of the drive element is drivingly connected with form fit to the second teeth of the second sprocket wheel and the second teeth of the second sprocket wheel project in the radial direction between the second followers;

the second sprocket wheel comprising second follower surfaces interacting with the second followers of the coupling section, respectively, wherein in a circumferential direction of the second sprocket wheel in the at least one rotary direction of the drive element a subset of the second follower surfaces of the second sprocket wheel are contacting a subset of the second followers of the coupling section when the second sprocket wheel is used in place of the first sprocket wheel;

wherein the first followers are positioned at a first spacing relative to each other in the rotary direction of the drive element and the first spacing has a first length and the second followers are positioned at a second spacing relative to each other in the rotary direction of the drive element and the second spacing has a second length;

wherein the first followers and the second followers are positioned at a third spacing relative to each other in the rotary direction of the drive element and the third spacing has a third length;

wherein the first length is different from the second length;

wherein the third length is different from the first length and different from the second length;

wherein the coupling section contacts with the first followers the first follower surfaces of the first sprocket wheel or with the second followers the second follower surfaces of the second sprocket wheel when the second sprocket wheel is used in place of the first sprocket wheel.

2. The drive system according to claim 1, wherein the first follower surfaces of the first sprocket wheel are formed on the first teeth of the first sprocket wheel and wherein the second follower surfaces of the second sprocket wheel are formed on the second teeth of the second sprocket wheel.

3. The drive system according to claim 2, wherein the first followers or the second followers engage across a partial width the first teeth of the first sprocket wheel or the second teeth of the second sprocket wheel, wherein the partial width is less than 30% of an axial total width of the first teeth of the first sprocket wheel or the second teeth of the second sprocket wheel.

4. The drive system according to claim 1, wherein in a circumferential direction of the drive element two of the first followers form a first follower pair and two of the second followers form a second follower pair, wherein the first follower pair delimits a first receptacle for one tooth of the first teeth of the first sprocket wheel and the second follower pair delimits a second receptacle for one tooth of the second teeth of the second sprocket wheel.

5. The drive system according to claim 4, wherein in the circumferential direction of the drive element several of the first receptacle and several of the second receptacle are alternatingly arranged.

6. The drive system according to claim 5, wherein relative to an axis of rotation of the drive element the first receptacles are arranged diametrically opposed to each other and the second receptacles are arranged diametrically opposed to each other.

7. The drive system according to claim 5, wherein the drive element has an axial plane and the first and second followers are symmetrically arranged relative to the axial plane.

8. The drive system according to claim 4, wherein said first spacing with said first length defines a spacing of the first receptacle, measured in the circumferential direction of the drive element, and said second spacing with said second length defines a spacing of the second receptacle, wherein the first length is greater than the second length.

9. The drive system according to claim 8, wherein, between the first receptacle and the second receptacle, an idle distance section is provided in the circumferential direction of the drive element that is defined by said third spacing with said third length and wherein said third length that is greater than the first length of the first receptacle.

10. The drive system according to claim 9, wherein said third length is at least twice as long as the first length of the first receptacle.

11. The drive system according to claim 4, wherein the tooth of the first sprocket wheel in the circumferential direction of the drive element is secured without clearance in the first receptacle or the tooth of the second sprocket wheel in the circumferential direction of the drive element is secured without clearance in the second receptacle.

12. The drive system according to claim 4, wherein the first teeth of the first sprocket wheel include neighboring teeth in a circumferential direction of the first sprocket wheel, wherein the neighboring teeth of the first sprocket wheel are resting on the first and the second followers and wherein one of neighboring teeth of the first sprocket wheel is arranged in the first receptacle, or wherein the second teeth of the second sprocket wheel include neighboring teeth in a circumferential direction of the second sprocket wheel, wherein the neighboring teeth of the second sprocket wheel are resting on the first and the second followers and wherein one of the neighboring teeth of the second sprocket wheel is arranged in the second receptacle.

13. The drive system according to claim 1, wherein, when the first sprocket wheel or the second sprocket wheel is connected with form fit to the drive element, only a subset of the first teeth of the first sprocket wheel or a subset of the second teeth of the second sprocket wheel are drivingly connected with the first and second followers.

14. The drive system according to claim 1, wherein the first and second followers have a radial clearance relative to a base between adjacently positioned first teeth of the first sprocket wheel or adjacently positioned second teeth of the second sprocket wheel.

15. The drive system according to claim 1, wherein the first sprocket wheel has a first number of first teeth and the second sprocket wheel has a second number of second teeth and wherein the first number of first teeth is different from the second number of second teeth.

16. The drive system according to claim 1, wherein the first sprocket wheel has a first pitch and the second sprocket wheel has a second pitch, wherein the first pitch is different from the second pitch.

17. A drive system for a supply pump of a motor chain saw, wherein the motor chain saw comprises:

a drive motor;

a saw chain;

a first sprocket wheel comprising first teeth configured to engage the saw chain for driving the saw chain and a second sprocket wheel comprising second teeth configured to engage the saw chain for driving the saw chain, wherein the first sprocket wheel or the second sprocket wheel is selected to be operatively connected to the drive motor, respectively;

wherein the first teeth are arranged on the first sprocket wheel at a first identical equidistant angular spacing and the second teeth are arranged on the second sprocket wheel at a second identical equidistant angular spacing;

wherein the first sprocket wheel with the first teeth has a first geometry and the second sprocket wheel with the second teeth has a second geometry different from the first geometry;

a supply pump supplying the saw chain with chain oil for lubricating the saw chain;

a pump drive operatively connected to the supply pump and comprising a first drive wheel and a second drive wheel, wherein the first drive wheel is connected to the supply pump and the second drive wheel is connected to the first sprocket wheel, and wherein the first and second drive wheels are drivingly connected with each other;

a drive element comprising a coupling section, wherein the second drive wheel is formed on the drive element;

the coupling section having a plurality of first followers and a plurality of second followers, wherein the first followers and the second followers radially project between the first teeth of the first sprocket wheel or the second teeth of the second sprocket wheel, wherein in at least one rotary direction of the drive element at least one of the first followers or at least one of the second followers produces a form-fit drive connection with the first sprocket wheel or the second sprocket wheel, respectively;

wherein the first followers and the second followers are arranged in a circumferential direction of the coupling section and a spacing between the first and the second followers that are neighboring each other in the circumferential direction varies, wherein at least two neighboring first followers define a first space between them defining a first spacing and wherein at least two neighboring second followers define a second space between them defining a second spacing, wherein the first and the second spacings are different from each other, wherein, when the first sprocket wheel is selected, one of the first teeth of the first sprocket wheel engages the first space to produce the drive connection, and wherein, when the second sprocket wheel is selected, one of the second teeth of the second sprocket wheel engages the second space to produce the drive connection.

18. The drive system according to claim 17, wherein a circumferential spacing measured in the circumferential direction between one of the first teeth or of one of the second teeth and a follower trailing said one first or second tooth in the rotational direction is different from a second circumferential spacing measured in the circumferential direction between another one of the first teeth or the second teeth and a follower trailing said other first or second tooth in the rotational direction.

* * * * *